US006579152B1

(12) United States Patent
Kimura

(10) Patent No.: US 6,579,152 B1
(45) Date of Patent: Jun. 17, 2003

(54) POLISHING APPARATUS

(75) Inventor: Norio Kimura, Fujisawa (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 09/422,802

(22) Filed: Oct. 22, 1999

Related U.S. Application Data

(62) Division of application No. 09/028,323, filed on Feb. 24, 1998, now Pat. No. 5,980,685.

(30) Foreign Application Priority Data

Feb. 24, 1997 (JP) ..... 9-055504

(51) Int. Cl.[7] ..... B24B 7/22
(52) U.S. Cl. ..... 451/41; 451/504
(58) Field of Search ..... 451/488, 41, 53, 451/449, 288, 287, 504

(56) References Cited

U.S. PATENT DOCUMENTS

| | | | | | |
|---|---|---|---|---|---|
| 4,313,284 | A | * | 2/1982 | Walsh | 451/288 |
| 4,450,652 | A | * | 5/1984 | Walsh | 451/288 |
| 4,918,869 | A | | 4/1990 | Kitta | 451/288 |
| 5,036,630 | A | * | 8/1991 | Kaanta et al. | 451/288 |
| 5,486,129 | A | | 1/1996 | Sandhu et al. | |
| 5,605,499 | A | | 2/1997 | Sugiyama et al. | 451/443 |
| 5,651,724 | A | * | 7/1997 | Kimura et al. | 451/288 |
| 5,718,620 | A | * | 2/1998 | Tanaka et al. | 451/288 |
| 5,766,058 | A | * | 6/1998 | Lee et al. | 451/41 |
| 5,840,202 | A | | 11/1998 | Walsh | 156/345 |
| 5,916,012 | A | | 6/1999 | Pant et al. | |
| 6,113,466 | A | * | 9/2000 | Lin | 451/41 |

FOREIGN PATENT DOCUMENTS

| | | |
|---|---|---|
| EP | 0 562 718 A1 | 9/1993 |
| EP | 0 579 298 A1 | 1/1994 |
| EP | 0 607 441 A1 | 7/1994 |
| EP | 0 756 917 A1 | 2/1997 |

* cited by examiner

*Primary Examiner*—Robert A. Rose
(74) *Attorney, Agent, or Firm*—Wenderoth, Lind & Ponack, L.L.P.

(57) ABSTRACT

A polishing apparatus is used for polishing a workpiece such as a semiconductor wafer to a flat mirror finish. The polishing apparatus includes a turntable having a polishing surface, and a top ring having a pressing surface for holding a workpiece to be polished and pressing the workpiece against the polishing surface of the turntable. At least one of the polishing surface of the turntable and the pressing surface of the top ring is a curved surface such as a convex surface or a concave surface.

24 Claims, 3 Drawing Sheets

FLATNESS OF TURNTABLE
μm
+10
0
−10
−300
0
+300
DISTANCE FROM TABLE CENTER (mm)

FLATNESS OF TURNTABLE
μm
+10
0
−10
−300
0
+300
DISTANCE FROM TABLE CENTER (mm)

THICKNESS OF REMOVED MATERIAL (Å)
6000
5000
4000
3000
2000
1000
0
−100
−50
0
50
100
DISTANCE FROM WAFER CENTER (mm)

THICKNESS OF REMOVED MATERIAL (Å)
6000
5000
4000
3000
2000
1000
0
−100
−50
0
50
100
DISTANCE FROM WAFER CENTER (mm)

POLISHING APPARATUS

This is a Divisional of Ser. No. 09/028,323, filed Feb. 24, 1998 now U.S. Pat. No. 5,980,685.

BACKGROUND OF THE INVENTION

1. Field of the Invention

The present invention relates to a polishing apparatus for polishing a workpiece, and more particularly to a polishing apparatus for polishing a workpiece such as a semiconductor wafer to a flat mirror finish.

2. Description of the Related Art

Recent rapid progress in semiconductor device integration demands smaller and smaller wiring patterns or interconnections and also narrower spaces between interconnections which connect active areas. One of the processes available for forming such interconnection is photolithography. Though the photolithographic process can form interconnections that are at most 0.5 $\mu$m wide, it requires that surfaces on which pattern images are to be focused by a stepper be as flat as possible because the depth of focus of the optical system is relatively small. Conventionally, as apparatuses for planarizing semiconductor wafers, there have been used a self-planarizing CVD apparatus, an etching apparatus or the like, however, these apparatuses fail to fully planarize semiconductor wafers. Recently, attempts have been made to use a polishing apparatus for planarizing semiconductor wafers to a flatter finish with more ease than those conventional planarizing apparatuses.

Conventionally, a polishing apparatus has a turntable and a top ring which rotate at respective individual speeds. A polishing cloth is attached to the upper surface of the turntable. A semiconductor wafer to be polished is placed on the polishing cloth and clamped between the top ring and the turntable. An abrasive liquid containing abrasive grains is supplied onto the polishing cloth and retained on the polishing cloth. During operation, the top ring exerts a certain pressure on the turntable, and the surface of the semiconductor wafer held against the polishing cloth is therefore polished by a combination of chemical polishing and mechanical polishing to a flat mirror finish while the top ring and the turntable are rotated. This process is called Chemical Mechanical polishing.

Attempts have heretofore been made to apply an elastic pad of polyurethane or the like to a workpiece holding surface of the top ring for uniformizing a pressing force applied from the top ring to the semiconductor wafer. If the pressing force applied from the top ring to the semiconductor wafer is uniformized, the semiconductor wafer is prevented from being excessively polished in a local area, and hence is polished to a highly flat finish.

The polishing apparatus is required to have such performance that the surfaces of semiconductor wafers have a highly accurate flatness. Therefore, it is preferable that the lower end surface of the top ring which holds a semiconductor wafer, and the contact surface of the polishing cloth which is held in contact with the semiconductor wafer, and hence the upper surface of the turntable to which the polishing cloth is attached, have a highly accurate flatness, and those highly accurately flat surfaces which are kept parallel to each other in cooperation with a gimbal mechanism of the top ring unit have been used in the art.

In order to prevent a polishing surface, i.e. an upper surface of the turntable, from being deformed into an upwardly convex shape due to frictional heat generated in a polishing process, there has been proposed a technique in which the turntable comprises an upper plate and a lower plate which are laminated and made up of materials having different coefficients of thermal expansion. Specifically, the coefficient of thermal expansion of the upper plate is smaller than that of the lower plate, and even if the temperature of the turntable is raised due to frictional heat generated in the polishing process, the upper and lower plates expand equally because there is a temperature difference between the upper plate and the lower plate, thus keeping the upper surface (the polishing surface) of the turntable flat. As a result, both of the lower end surface of the top ring and the upper surface of the turntable are kept flat, and parallelism of both surfaces is maintained in cooperation with a gimbal mechanism of the top ring unit.

Further, for solving this kind of problem, there has been proposed another technique in which the upper surface of the turntable is deformed into an upwardly convex shape due to frictional heat generated in the polishing process, and the lower end surface of the top ring (or carrier) is caused to be deformed into a concave shape opening toward the bowed turntable by evacuating air in a chamber formed in the top ring so as to conform to the bowed turntable. Thus, the upper surface of the turntable and the lower end surface of the top ring are kept parallel to each other for improving polished wafer flatness.

Efforts have been made to find an ideal polishing surface, i.e., an ideal upper surface of the turntable and/or an ideal pressing surface, i.e., an ideal lower end surface of the top ring by inventors of the present application. It is found by the inventors that the upper surface of the turntable and the lower end surface of the top ring which are not necessarily flat are desirable.

SUMMARY OF THE INVENTION

It is therefore an object of the present invention to provide a polishing apparatus which can polish a workpiece such as a semiconductor wafer to a flat mirror finish over the entire surface thereof even if the workpiece has a large diameter.

According to one aspect of the present invention, there is provided an apparatus for polishing a surface of a workpiece, the apparatus comprising: a turntable having a polishing surface; and a top ring having a pressing surface for holding a workpiece to be polished and pressing the workpiece against the polishing surface of the turntable; wherein at least one of the polishing surface of the turntable and the pressing surface of the top ring is a curved surface.

According to another aspect of the present invention, there is provided an apparatus for polishing a surface of a workpiece, the apparatus comprising: a turntable having a polishing surface; and a top ring having a pressing surface for holding a workpiece to be polished and pressing the workpiece against the polishing surface of the turntable; wherein the polishing surface of the turntable is a spherical convex surface having a radius of curvature ranging from 500 to 5,000 m.

The polishing surface of the turntable is defined as "a surface to which a polishing cloth is attached if the polishing cloth is used or a surface which contacts a workpiece directly if the polishing cloth is not used." The pressing surface of the top ring is defined as "a surface to which an elastic pad is attached if the elastic pad is used or a surface which contacts the workpiece directly if the elastic pad is not used".

According to the present invention, the polishing pressure which is applied to the workpiece clamped between the pressing surface, i.e. the lower end surface of the top ring, and the polishing surface, i.e. the upper surface of the turntable, can be uniformized over the entire surface of the workpiece. Therefore, the local area of the workpiece is prevented from being polished excessively or insufficiently, and the entire surface of workpiece can thus be polished to a flat mirror finish. In the case where the present invention is applied to semiconductor manufacturing processes, the semiconductor devices can be polished to a high quality, and yields of the semiconductor devices can be increased.

The above and other objects, features, and advantages of the present invention will become more apparent from the following description when taken in conjunction with the accompanying drawings in which a preferred embodiment of the present invention is shown by way of illustrative example.

DETAILED DESCRIPTION OF THE PREFERRED EMBODIMENT

Next, a polishing apparatus according to an embodiment of the present invention will be described below with reference to FIGS. 1 through 3D.

Figure 1:
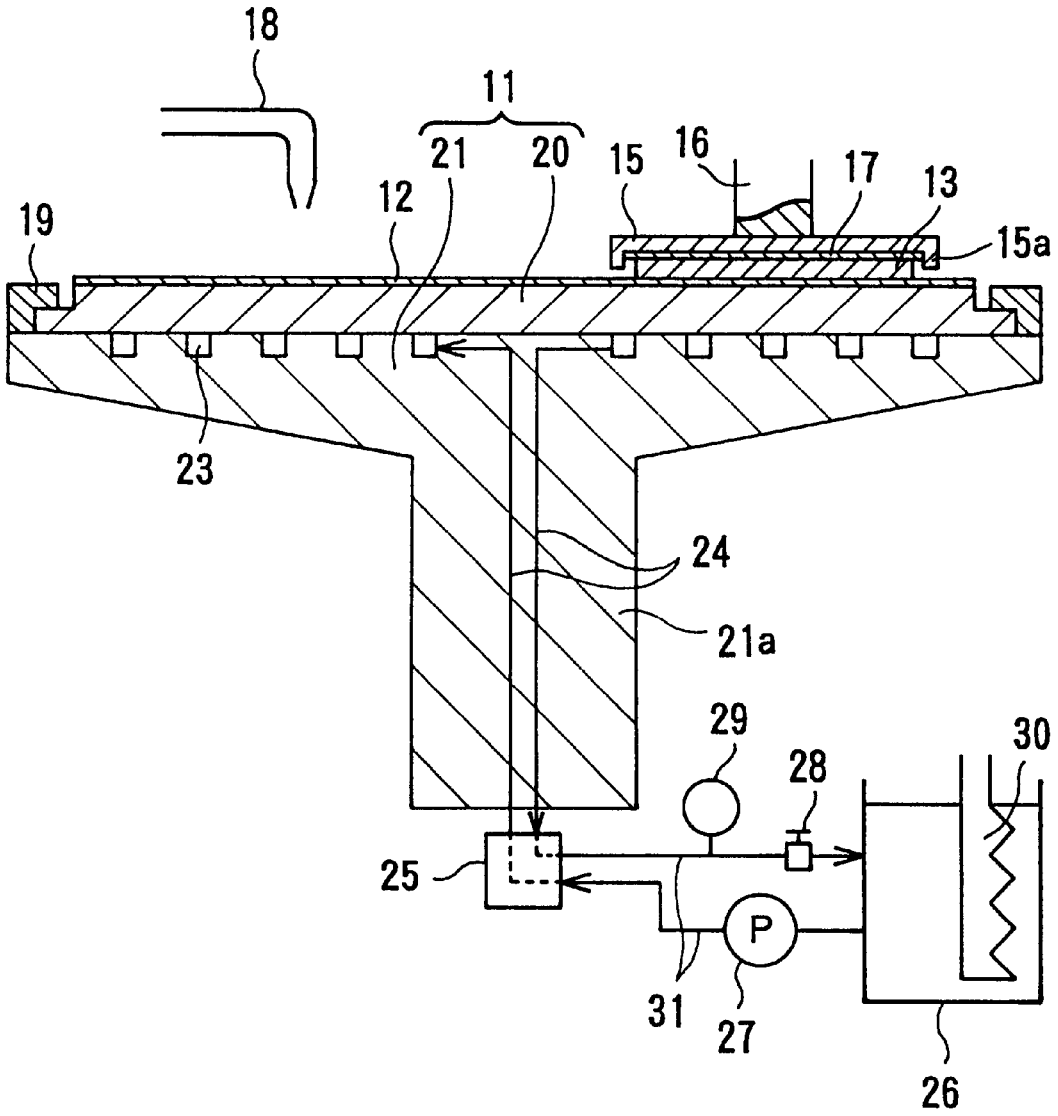
FIG. 1 is a schematic view of a polishing apparatus according to an embodiment of the present invention.

FIG. 1 shows main components of the polishing apparatus according to the present invention. As shown in FIG. 1, a polishing apparatus comprises a turntable 11 having a polishing surface i.e., an upper surface to which a polishing cloth 12 is attached, a top ring 15 for holding a semiconductor wafer 13 to be polished and pressing the semiconductor wafer 13 against the polishing cloth 12, and an abrasive liquid nozzle 18 for supplying an abrasive liquid containing abrasive grains onto the polishing cloth 12. The turntable 11 is rotatable about its own axis by a motor (not shown). The top ring 15 is connected through a gimbal mechanism such as a spherical bearing (not shown) to a top ring shaft 16 which is coupled to a motor (not shown) and an air cylinder (not shown). The top ring 15 is also provided with an elastic pad 17 of polyurethane or the like on the pressing surface, i.e. the lower end surface. The semiconductor wafer 13 is held by the top ring 15 in contact with the elastic pad 17. The top ring 15 also has a cylindrical retaining portion 15*a* on an outer circumferential edge thereof for retaining the semiconductor wafer 13 on the lower end surface of the top ring 15. Specifically, the retaining portion 15*a* has a lower end projecting downwardly from the lower end surface of the top ring 15 for holding the semiconductor wafer 13 on the elastic pad 17 against disengagement from the top ring 15 under frictional engagement with the polishing cloth 12 during a polishing process.

In operation, the semiconductor wafer 13 is held against the lower surface of the elastic pad 17 which is attached to the lower end surface of the top ring 15. The semiconductor wafer 13 is then pressed against the polishing cloth 12 attached to the polishing surface, i.e. the upper surface of the turntable 11 by the top ring 15, and the turntable 11 and the top ring 15 are rotated independently of each other to move the polishing cloth 12 and the semiconductor wafer 13 relatively to each other, thereby polishing the semiconductor wafer 13. The abrasive liquid supplied from the abrasive liquid supply nozzle 18 comprises an alkaline liquid containing abrasive grains of fine particles suspended therein, for example. The semiconductor wafer 13 is therefore polished by a combination of chemical polishing and mechanical polishing.

The turntable 11 comprises an upper plate 20 and a lower plate 21. A fluid passage 23 is defined between the upper and lower plates 20 and 21 to allow cooling water to pass therethrough. The upper plate 20 is securely fixed to the lower plate 21 at the outer periphery of the upper plate 20. The outer peripheral portions of the upper and lower plates are sealed by an O ring (not shown) interposed therebetween.

The lower plate 21 has at its lower end a shaft portion 21*a* which is coupled to the motor (not shown). A fluid passage 24 is defined in the shaft portion 21*a* and the lower plate 21. The fluid passage 24 is connected to a tank 26 through a rotary joint 25 and a piping 31. A pump 27, a valve 28 and a pressure gage 29 are provided between the tank 26 and the rotary joint 25. The cooling water stored in the tank 26 is pressurized by the pump 27 and supplied to the fluid passage 23 between the upper and lower plates 20 and 21 through the piping 31, the rotary joint 25 and the fluid passage 24, and is returned to the tank 26 through the fluid passage 24, the rotary joint 25 and the piping 31.

The pressure of the cooling water is adjusted by regulating the valve 28, and is monitored by the pressure gage 29. A cooling device 30 is provided in the tank 26 to cool water in the tank 26. The frictional heat generated in the polishing process is absorbed by the cooling water flowing through the fluid passage 23 defined in the turntable 11 to prevent a temperature rise on the upper surface of the turntable 11 and to thus prevent excessive or undesirable deformation of the upper surface of the turntable 11 caused by thermal expansion of the turntable 11.

The upper and lower plates 20 and 21 are made up of a material having coefficient of thermal expansion of not more than $5\times10^{-6}/°$ C. Materials such as austenitic cast iron having low coefficient of thermal expansion are suited for the turntable. Austenitic cast iron has low coefficient of thermal expansion, and possesses excellent castability, machinability and vibration absorbing characteristics. By application of materials of low coefficient of thermal expansion to the turntable, it is possible to prevent the upper surface of the turntable 11 from being excessively or undesirably deformed into a convex shape even when frictional heat is generated during polishing.

Figure 2:
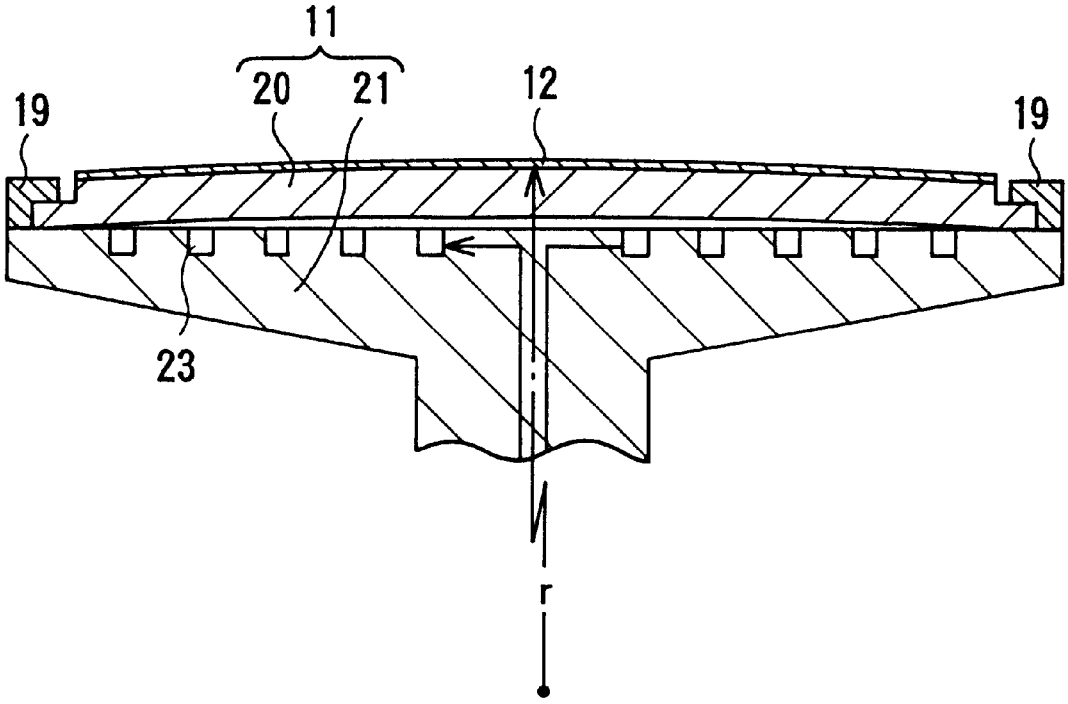
FIG. 2 is a schematic view of a turntable having a slightly convex surface according to an embodiment of the present invention.

FIG. 2 shows a condition of the turntable 11 when the (fluid passage 23 is filled with pressurized cooling water.

The upper surface of the upper plate 20 is deformed by pressure of the cooling water into a convex shape whose shape is exaggerated in FIG. 2 for the sake of illustrative clarity because the outer periphery of the upper plate 20 is securely held by flange 19 and sealed by the O ring (not shown). The deformation of the upper plate 20 leads to a central portion of the upper surface being higher than the outer peripheral portion of the upper surface by 9 to 100 $\mu$m. This camber or bowing corresponds to a spherical surface having a radius r of curvature ranging from 500 to 5,000 m in the case of the turntable having a diameter of 600 mm.

A suitable range of pressure of the cooling water is in the range of 1 kgf/cm$^2$ to 10 kgf/cm$^2$, and preferably is about 2 kgf/cm$^2$. The purpose of supplying cooling water is not only to make the upper surface of the turntable a spherical surface having a suitable radius of curvature but also to cool the upper surface, i.e., the polishing surface of the turntable. This cooling of the turntable prevents a temperature rise of the turntable caused by heat generated in the polishing process to thus keep a desired radius of curvature in the upper surface of the turntable. Therefore, in parallel with selection of material having a low coefficient of thermal expansion, the cooling effect of the cooling water prevents the excessive or undesirable deformation of the turntable, especially the upper plate 20.

The top ring 15 has a lower end surface, i.e. a pressing surface for pressing the semiconductor wafer against the upper surface of the turntable, which is formed by lapping into a spherical surface of a concave shape or a convex shape. The radius of curvature of the spherical surface of the top ring 15 is in the range of 500 to 5,000 m. This values correspond to a height difference ranging from 1.0 to 11.0 $\mu$m between the central portion and the outer peripheral portion of the lower end surface of the top ring 15. The lapping is suited for forming a slightly concave or convex surface rather than a perfect flat surface.

Figure 3A:
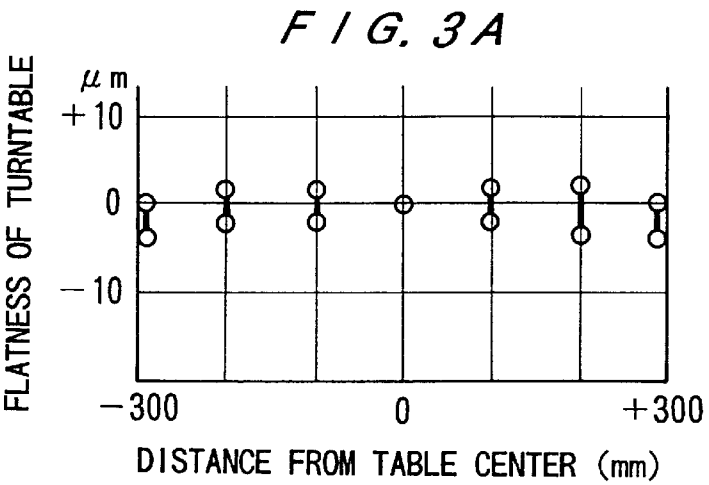
FIGS. 3A through 3D are graphs showing the polishing characteristics of semiconductor wafers which were polished by the polishing apparatus of the present invention and the conventional polishing apparatus.
Figure 3C:
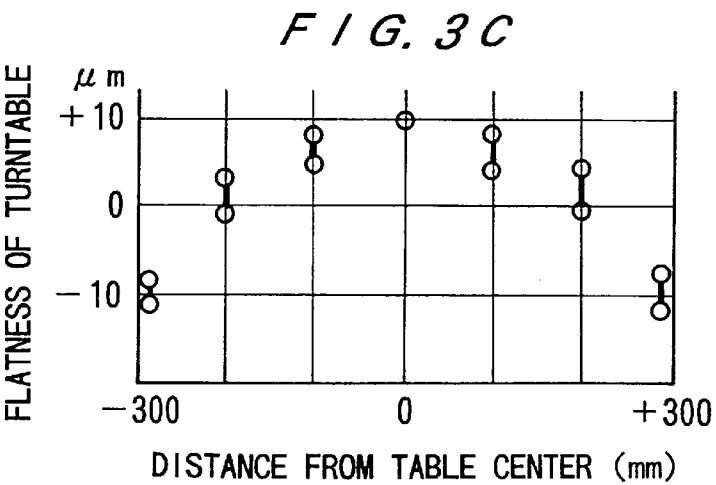
Figure 3B:
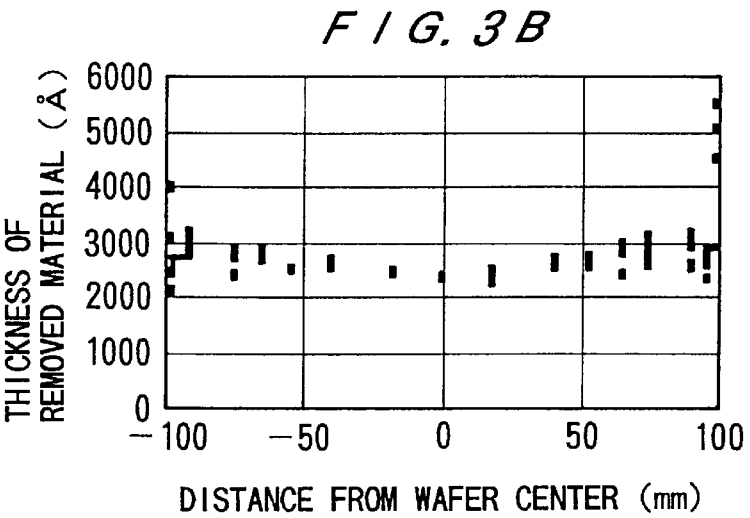
Figure 3D:
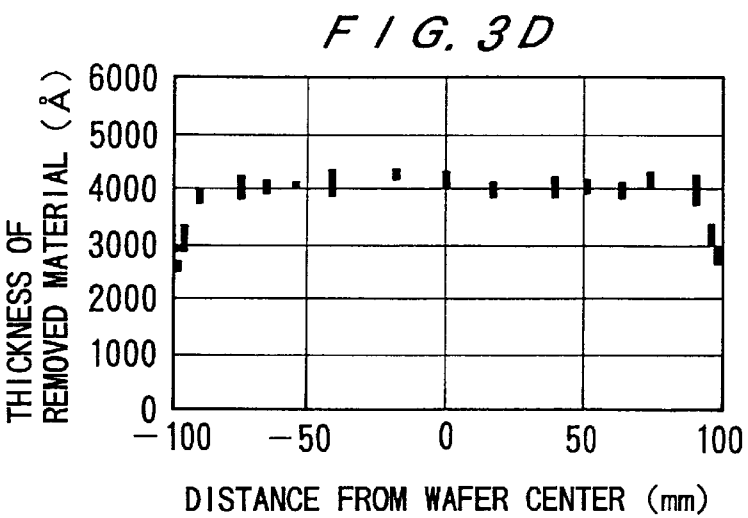

FIGS. 3A through 3D show comparative results of an experiment in which semiconductor wafers were polished by the polishing apparatus of the present invention and the conventional polishing apparatus. FIGS. 3A and 3B show the results obtained by the conventional polishing apparatus, and FIGS. 3C and 3D show the results obtained by the polishing apparatus of the present invention. The top ring used in the experiment had a lower end surface which was formed into a concave surface whose central portion is deeper than the peripheral portion by approximately 1.0 $\mu$m. This configuration corresponds to a spherical surface having a radius of curvature of approximately 5,000 m.

FIG. 3A shows measurements of flatness in the upper surface of the conventional turntable, and FIG. 3C shows measurements of flatness in the upper surface of the turntable having a radius of curvature of about 2,300 m in the present invention. In FIGS. 3A and 3C, the horizontal axis represents a distance (mm) from the center of the turntable, and the vertical axis represents flatness of the turntable.

As shown in FIG. 3A, the conventional turntable has a surface irregularity of 2 to 3 $\mu$m with respect to its central portion. As shown in FIG. 3C, the turntable of the present invention has a convex upper surface whose central portion is higher than the peripheral portion by approximately 20 $\mu$m. This configuration corresponds to a spherical surface having a radius of curvature of approximately 2,300 m. The surface irregularity of the turntable is in the range of 2 to 3 $\mu$m as in the conventional turntable. In both cases of FIGS. 3A and 3C, the turntable had a diameter of 600 mm and the top ring had a diameter of 200 mm.

FIG. 3B shows the results of measurements in which a semiconductor wafer was polished using the turntable of FIG. 3A. FIG. 3D shows the results of measurements in which a semiconductor wafer was polished using the turntable of FIG. 3C. The semiconductor wafers used in the experiments were 8-inch semiconductor wafers, i.e. semiconductor wafers having a large diameter of 200 mm. In FIGS. 3B and 3D, the horizontal axis represents a distance (mm) from the center of the semiconductor wafer, and the vertical axis represents a thickness (Å) of a material removed from the semiconductor wafer.

As shown in FIG. 3B, the uniformity of the amount of removed material in the radial direction of the semiconductor wafer is 8.2%. In contrast, as shown in FIG. 3D, the uniformity of the amount of removed material in the radial direction of the semiconductor wafer is 2.8%.

As demonstrated by the above two examples, although the top ring has the same lower surface contour in both cases, the uniformity of the amount of removed material across the whole diameter of the semiconductor wafer is significantly improved by using the turntable having a slightly convex upper surface whose radius of curvature is 2,300 m, compared with the conventional turntable having a flat upper surface.

The experimental results prove that in the case of using the top ring having a concave lower end surface and the turntable having a flat upper surface, the top ring contacts the semiconductor wafer primarily at the outer peripheral portion thereof to apply excessive pressure to the outer peripheral portion, so that the amount of material removed from the peripheral portion of the semiconductor wafer is greater than the amount of material removed from other regions of the semiconductor wafer to thus degrade the uniformity of the amount of removed material in the radial direction of the semiconductor wafer.

In the above experiment, the top ring had a concave lower end surface whose central portion is deeper than the outer peripheral portion by approximately 1.0 $\mu$m. In the case of using a top ring having a convex lower end surface whose central portion is higher than the outer peripheral portion by approximately 1.5 $\mu$m and the turntable having the same convex upper surface as that in the above experiment, the uniformity of the amount of removed material dropped slightly and was approximately 3.5%. The dimension of 1.5 $\mu$m corresponds to a radius of curvature of 3,300 m. In other words, a combination of the turntable 11 with a convex polishing surface and the top ring 15 with a concave pressing surface creates that the polishing surface of the turntable and the pressing surface of the top ring are in parallel to each other over the entire pressing surface of the top ring to thereby apply uniform polishing pressure over the entire surface of the semiconductor wafer.

In the above embodiment, the workpiece to be polished by the polishing apparatus has been described as a semiconductor wafer. However, the polishing apparatus according to the present invention may be used to polish other workpieces including a glass product, a liquid crystal panel, a ceramic product, etc.

Although a certain preferred embodiment of the present invention has been shown and described in detail, it should be understood that various changes and modifications may be made therein without departing from the scope of the appended claims.

What is claimed is:

1. A method of polishing a surface of a workpiece, said method comprising:

holding said workpiece between a polishing surface of a table and a pressing surface of a top ring; and pressing said pressing surface against said workpiece, and thereby pressing said surface of said workpiece against said polishing surface; and polishing said surface of said workpiece while maintaining said polishing surface as a deformed surface, wherein said table includes a fluid chamber therein, said maintaining of said polishing surface as said deformed surface comprising supplying pressurized fluid to said fluid chamber and regulating the supply of pressurized fluid such that the pressure of said fluid in said fluid chamber is sufficient to thus form said deformed surface of said polishing surface.

2. A method as claimed in claim 1, wherein said deformed polishing surface comprises a convex surface.

3. A method as claimed in claim 2, wherein said table comprises an upper plate and a lower plate, said fluid chamber being defined between said upper plate and said lower plate, and said maintaining comprises supplying the pressurized fluid under to said fluid chamber to thus form said convex surface.

4. A method as claimed in claim 1, wherein said pressing surface comprises a concave surface.

5. A method as claimed in claim 1, wherein said pressing surface is defined by an elastic pad, and said polishing surface is defined by a polishing cloth.

6. A method as claimed in claim 1, wherein said curved surface comprises a spherical surface having a radius of curvature of from 500 to 5000 m.

7. A method as claimed in claim 1, wherein said table is of a material having a low coefficient of thermal expansion.

8. A method as claimed in claim 7, wherein said coefficient of thermal expansion is no greater than $5\times10^{-6}$/° C.

9. A method of polishing a surface of a workpiece, said method comprising:

holding said workpiece between a polishing surface of a table and a pressing surface of a top ring; and pressing said pressing surface against said workpiece, and thereby pressing said surface of said workpiece against said polishing surface; and polishing said surface of said workpiece while maintaining said polishing surface as a spherical convex surface with a desired radius of curvature of from 500 to 5000 m;

wherein said table comprises an upper plate and a lower plate, with a fluid chamber defined between said upper plate and said lower plate, and said maintaining comprises supplying pressurized fluid to said fluid chamber and regulating the supply of pressurized fluid such that the pressure of said fluid in said fluid chamber is sufficient to thus form said convex surface.

10. A method of fabricating a semiconductor device, said method comprising:

holding a semiconductor wafer between a convex polishing surface of a table and a pressing surface of a top ring; and pressing said pressing surface against said wafer, and thereby pressing a surface of said wafer against said convex polishing surface; and polishing said surface of said wafer while maintaining said convex polishing surface with a desired radius of curvature;

wherein said table comprises an upper plate and a lower plate, with a fluid chamber defined between said upper plate and said lower plate, and said maintaining comprises supplying pressurized fluid to said fluid chamber and regulating the supply of pressurized fluid such that the pressure of said fluid in said fluid chamber is sufficient to thus form said convex surface.

11. A method as claimed in claim 10, wherein said pressing surface comprises a concave surface.

12. A method as claimed in claim 10, wherein said pressing surface is defined by an elastic pad, and said polishing surface is defined by a polishing cloth.

13. A method as claimed in claim 10, wherein said curved surface comprises a spherical surface having a radius of curvature of from 500 to 5000 m.

14. A method as claimed in claim 10, wherein said table is of a material having a low coefficient of thermal expansion.

15. A method as claimed in claim 14, wherein said coefficient of thermal expansion is no greater than $5\times10^{-6}$/° C.

16. A method as claimed in claim 1, wherein said regulating of the supply of said pressurized fluid comprises adjusting a regulating valve located at an outlet side of said fluid chamber.

17. A method as claimed in claim 1, wherein said maintaining of said polishing surface with said deformed surface comprises supplying pressurized fluid through an inlet side of said fluid chamber and adjusting a regulating valve located at an outlet side of said fluid chamber so as to control a pressure of said pressurized fluid in said fluid chamber.

18. A method as claimed in claim 1, wherein said regulating of the supply of said pressurized fluid comprises maintaining a pressure of said pressurized fluid in said fluid chamber in a range of 1 kgf/cm$^2$ to 10 kgf/cm$^2$.

19. A method as claimed in claim 9, wherein said regulating of the supply of said pressurized fluid comprises adjusting a regulating valve located at an outlet side of said fluid chamber.

20. A method as claimed in claim 9, wherein said maintaining of said polishing surface as a spherical convex surface comprises supplying pressurized fluid through an inlet side of said fluid chamber and adjusting a regulating valve located at an outlet side of said fluid chamber so as to control a pressure of said pressurized fluid in said fluid chamber.

21. A method as claimed in claim 9, wherein said regulating of the supply of said pressurized fluid comprises maintaining a pressure of said pressurized fluid in said fluid chamber in a range of 1 kgf/cm$^2$ to 10 kgf/cm$^2$.

22. A method as claimed in claim 10, wherein said regulating of the supply of said pressurized fluid comprises adjusting a regulating valve located at an outlet side of said fluid chamber.

23. A method as claimed in claim 10, wherein said maintaining of said polishing surface as a convex polishing surface comprises supplying pressurized fluid through an inlet side of said fluid chamber and adjusting a regulating valve located at an outlet side of said fluid chamber so as to control a pressure of said pressurized fluid in said fluid chamber.

24. A method as claimed in claim 10, wherein said regulating of the supply of said pressurized fluid comprises maintaining a pressure of said pressurized fluid in said fluid chamber in a range of 1 kgf/cm$^2$ to 10 kgf/cm$^2$.

* * * * *

UNITED STATES PATENT AND TRADEMARK OFFICE

CERTIFICATE OF CORRECTION

PATENT NO. : 6,579,152 B1
DATED : June 17, 2003
INVENTOR(S) : Norio Kimura

It is certified that error appears in the above-identified patent and that said Letters Patent is hereby corrected as shown below:

Column 6,
Line 52, after "workpiece" insert -- to a flat mirror finish. --
Line 57, before "said workpiece" insert -- an entire surface of. --
Line 61, after "deformed surface" insert -- during said polishing. --

Column 7,
Line 21, after "workpiece" insert -- to a flat mirror finish. --
Line 25, before "said workpiece" insert -- an entire surface of. --
Line 31, after "m" insert -- during said polishing. --
Line 40, after "semiconductor device" insert -- to a flat mirror finish. --
Line 46, before "said water" insert -- an entire surface of. --
Line 51, after "curvature" insert -- during said polishing. --

Signed and Sealed this

Twenty-fifth Day of November, 2003

JAMES E. ROGAN
*Director of the United States Patent and Trademark Office*